United States Patent [19]

Stalzer

[11] Patent Number: 4,503,413

[45] Date of Patent: Mar. 5, 1985

[54] SPOOL FOR TRANSFORMER IN POWER SUPPLY DEVICE

[75] Inventor: Kurt Stalzer, Bruchköbel, Fed. Rep. of Germany

[73] Assignee: Telefonbau und Normalzeit GmbH, Frankfurt, Fed. Rep. of Germany

[21] Appl. No.: 448,379

[22] Filed: Dec. 9, 1982

[51] Int. Cl.[3] ..... H01F 15/10; H01F 27/30

[52] U.S. Cl. ..... 336/192; 336/208; 361/41

[58] Field of Search ..... 361/41, 35, 38, 39, 361/40; 336/192, 208, 198, 105

[56] References Cited

U.S. PATENT DOCUMENTS

| | | | |
|---|---|---|---|
| 3,191,135 | 6/1965 | Hazelquist | 336/65 |
| 3,566,322 | 2/1971 | Horbach | 336/192 |
| 3,585,450 | 6/1971 | Lane | 361/41 |
| 3,939,450 | 2/1976 | Donnelly | 336/208 X |
| 4,257,027 | 3/1981 | Yasuhisa | 336/208 X |
| 4,363,014 | 12/1982 | Leach et al. | 336/192 X |

FOREIGN PATENT DOCUMENTS

| | | | |
|---|---|---|---|
| 1858633 | 9/1962 | Fed. Rep. of Germany . | |
| 1919601 | 7/1965 | Fed. Rep. of Germany . | |
| 2146484 | 3/1973 | Fed. Rep. of Germany | 336/192 |
| 8010249 | 7/1980 | Fed. Rep. of Germany . | |
| 1345472 | 10/1963 | France | 336/192 |
| 158015 | 2/1979 | Netherlands | 336/192 |
| 1330797 | 9/1973 | United Kingdom | 336/192 |

OTHER PUBLICATIONS

"Coil Retainer", Nemier et al., IBM Technical Disclosure Bulletin, vol. 20, No. 4, Sep. 1977.

*Primary Examiner*—Thomas J. Kozma

*Attorney, Agent, or Firm*—Jacobson and Johnson

[57] ABSTRACT

A spool for a power supply transformer with one flange having attachments for providing the necessary connections to and from the transformer windings and holding fuses in place and another flange having slots for snap-in attachment to a baseplate.

4 Claims, 3 Drawing Figures

SPOOL FOR TRANSFORMER IN POWER SUPPLY DEVICE

This invention concerns a spool for a transformer for power supply devices. The spool is the core about which the transformer windings are wound.

In conventional power supply devices the mains current cable with its connecting terminals and suitable fuse holders is accommodated in a separate plastic box located beside the transformer. To this end, additional units such as a plastic box, terminal strips, fuse holders and the hardware for mounting on the baseplate are necessary and require a lot of space.

The object of the invention is to provide a spool which avoids the above drawbacks in power supply devices. The advantages and features of this invention are achieved by providing a spool for a transformer for a power supply device having a flange connected as one piece at one end with attachments for providing the necessary connecting box for the input mains current cable and the outgoing lines. One attachment provides a holder for the mains cable inlet with a friction release, molded connecting tongues or contacts for inserting the mains plugs and molded fuse holders comprising plastic resilient members. An insulating cover is provided over this one attachment to protect against unintentional touching.

A further feature is another attachment for the transformer secondary also provided on the same flange with molded plug tongues or contacts for connecting the outgoing wires and also with fuse holders similar to those in the first-described attachment.

As yet another feature, the flange at the other end contains slots for snap-in mounting of the spool to a suitable supporting baseplate.

According to the invention the features described are achieved with the mains current cable integrated with and attached to the necessary units in the spool in a shock-proof fashion.

The invention will be described in more detail with reference to the accompanying drawings in which.

Figure 1:
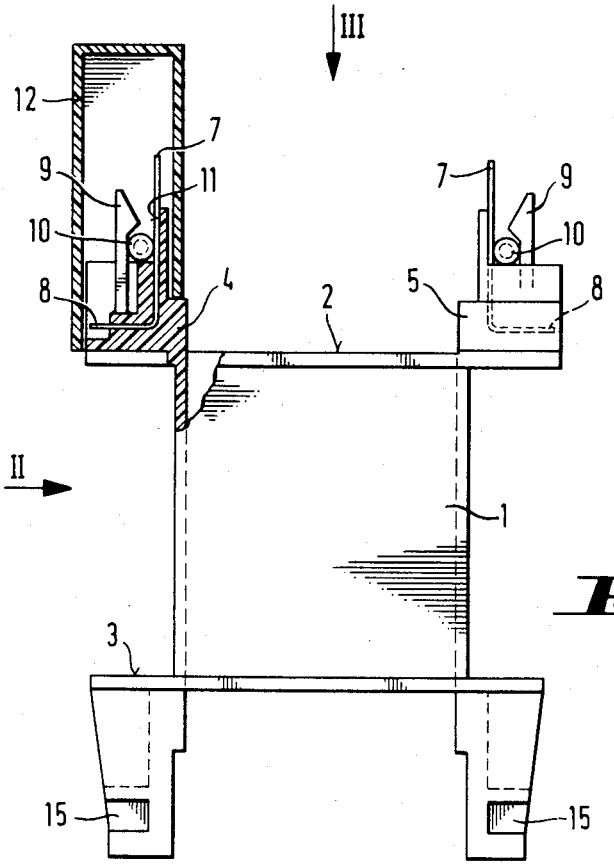
FIG. 1 shows a side view partly in section of a spool with a cap comprising an embodiment of the invention.
Figure 3:
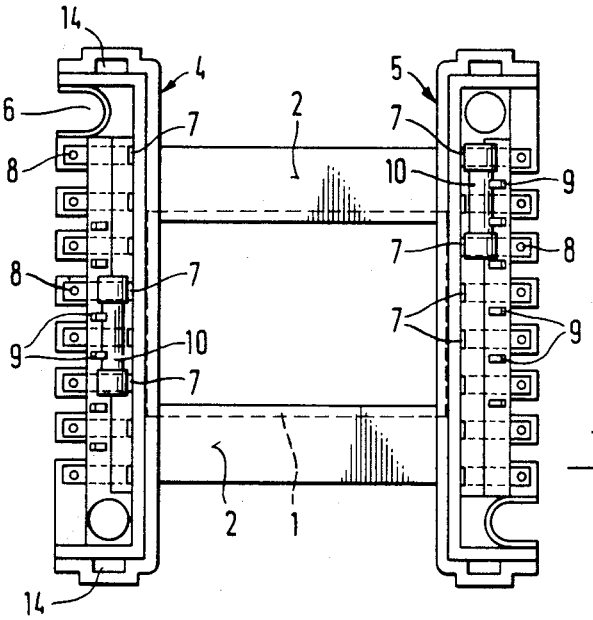
FIG. 3 shows a top view of the same embodiment as viewed from direction III of FIG. 1.
Figure 2:
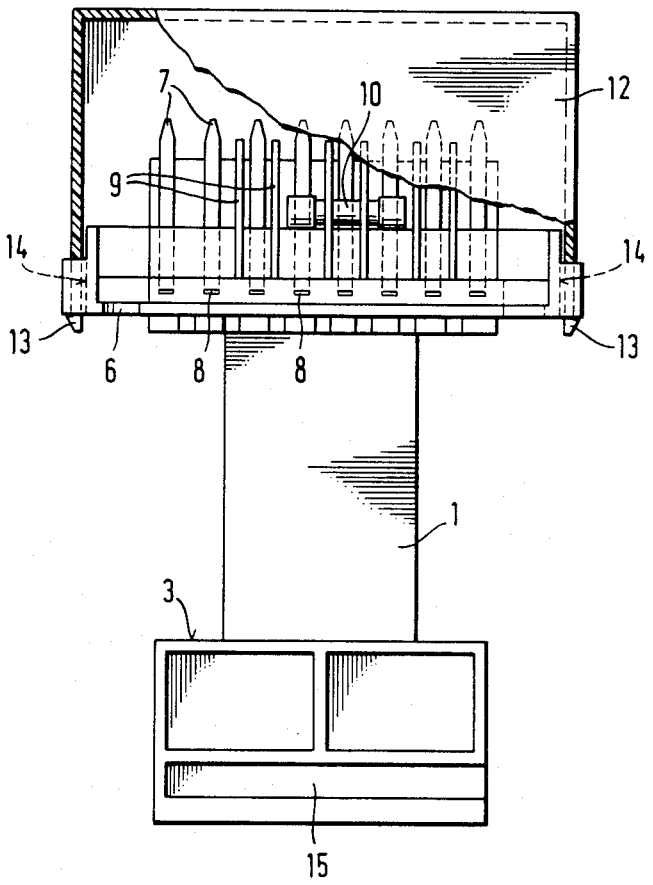
FIG. 2 shows a front view of the same embodiment as viewed from direction II of FIG. 1.

A spool 1, preferably made of a suitable plastic shown in FIGS. 1–3 for the transformer of a power supply device has a bobbin with an attached upper spool flange 2 and lower spool flange 3. Two attachments 4 and 5 are molded or integrally formed to the upper spool flange 2.

The attachment 4 serves for the connection of a mains cable, not shown in the figure. The mains cable is frictionally held with a traction release sleeve in the opening of clip 6 on the attachment 4. Molded connecting tongues or contacts 7, onto which are slipped the wire ends of the mains cable are also provided. The transformer primary windings on the spool are soldered to the ends 8 of the connecting tongues 7 for electrical connection.

In addition, resilient arms or plastic springs 9, which serve as fuse holders, are molded to the attachment 4. A fuse 10 is inserted between the plastic springs 9 and the inner wall 11 of the attachment 4 in such a way as to bridge between the required connecting tongues 7, as best seen in FIG. 3. This attachment 4 is protected against unintentional contact by means of an insulating cover 12 which is provided, for mounting purposes, with spring-type hooks 13 which pass through slots 14 of the attachment and latch onto the underside of the flange. The cover can additionally be more tightly secured by means of a screw, if desired.

The second attachment 5 on the upper flange 2 is for the transformer secondary connections and is likewise provided with molded plug tongues 7 for connection of outgoing wires, not shown. Likewise molded plastic springs 9 hold fuses 10, which interconnect between selected plug tongues 7.

The lower flange 3 of the spool extends downward and is provided with hang-in slots 15 for making snap-in connection to a supporting baseplate, not shown.

I claim:

1. A power supply transformer spool for carrying transformer windings comprising:

(a) a tubular bobbin with a flange (2) at an end;

(b) an attachment member (4) fixedly attached to said flange;

(c) clip means (6) coupled to said attachment member for releasably holding an inlet mains electrical cable;

(d) a series of spaced-apart elongated electrically conductive contacts (7) molded in place in said attachment member, each of said contacts having two ends for making electrical connection to the transformer or to the mains cable wires; and (e) non-conductive resilient arm means (9) extending out from said attachment member for releasably holding fuse means (10) electrically connected between two of said separated contacts.

2. The device as described in claim 1 further including an insulating cover (12) over said attachment member (4), said cover having downward extending resilient hooks (13) which releasably latch onto slots (14) in said flange (2).

3. The device as described in claim 1 further including another flange (3) attached at the other end of said bobbin, said another flange having a downward extension containing slots (15) adapted for snap-in mounting to a supporting baseplate.

4. The device as described in claim 1 including:

(a) a second attachment member (5) fixedly attached to said flange;

(b) an additional series of elongated spaced-apart electrically conductive contacts molded in place in said second attachment member having ends for making electrical connection to electrical wires; and (c) additional non-conductor resilient arm means extending out from said second attachment member for releasably holding a fuse electrically connected between two of said contacts.

* * * * *